US012419339B2

(12) United States Patent
Cabot

(10) Patent No.: US 12,419,339 B2
(45) **Date of Patent: *Sep. 23, 2025**

(54) AEROSOLIZED FORMULATION

(71) Applicant: NICOVENTURES TRADING LIMITED, London (GB)

(72) Inventor: Ross Cabot, London (GB)

(73) Assignee: Nicoventures Trading Limited, London (GB)

( * ) Notice: Subject to any disclaimer, the term of this patent is extended or adjusted under 35 U.S.C. 154(b) by 183 days.

This patent is subject to a terminal disclaimer.

(21) Appl. No.: 17/290,322

(22) PCT Filed: Oct. 31, 2019

(86) PCT No.: PCT/GB2019/053094

§ 371 (c)(1),
(2) Date: Apr. 30, 2021

(87) PCT Pub. No.: WO2020/089639

PCT Pub. Date: May 7, 2020

(65) Prior Publication Data

US 2021/0368852 A1 Dec. 2, 2021

(30) Foreign Application Priority Data

Nov. 1, 2018 (GB) ..... 1817860

(51) Int. Cl.
*A24B 15/167* (2020.01)
*A24F 40/05* (2020.01)
*A24F 40/10* (2020.01)

(52) U.S. Cl.
CPC ..... *A24B 15/167* (2016.11); *A24F 40/05* (2020.01); *A24F 40/10* (2020.01)

(58) Field of Classification Search
CPC ..... A24B 15/167
See application file for complete search history.

(56) References Cited

U.S. PATENT DOCUMENTS 4,223,292 A 9/1980 Morikawa et al.
4,588,976 A 5/1986 Jaselli
(Continued)

FOREIGN PATENT DOCUMENTS

AU 6195998 A 6/1998
AU 717600 B2 3/2000
(Continued)

OTHER PUBLICATIONS

International Search Report and Written Opinion for PCT/GB2019/053094 date mailed Feb. 4, 2020.
(Continued)

*Primary Examiner* — Russell E Sparks
(74) *Attorney, Agent, or Firm* — Womble Bond Dickinson (US) LLP

(57) ABSTRACT

An aerosolized formulation comprising (i) water in an amount of at least 50 wt. % based on the aerosolized formulation; and (ii) at least one flavor; wherein the aerosolized formulation contains the at least one flavor in an amount of at least 70 wt % of the said flavor present in the aerosolizable formulation from which the aerosolized formulation was formed. A process for forming an aerosol comprising the aerosolizable formulation, an electronic aerosol provision system having an aerosolizer for aerosolizing the aerosolizable formulation for inhalation by a user, and a process for improving flavor to an aerosolized formulation.

21 Claims, 1 Drawing Sheet

(56) References Cited

U.S. PATENT DOCUMENTS

| | | | | |
|---|---|---|---|---|
| 4,735,217 | A | 4/1988 | Gerth et al. | |
| 4,922,901 | A | 5/1990 | Brooks et al. | |
| 4,945,928 | A | 8/1990 | Rose | |
| 5,060,671 | A | 10/1991 | Counts et al. | |
| 5,095,921 | A | 3/1992 | Losee et al. | |
| 5,179,966 | A | 1/1993 | Losee et al. | |
| 5,222,362 | A | 6/1993 | Maus et al. | |
| 5,322,075 | A | 6/1994 | Deevi et al. | |
| 5,530,225 | A | 6/1996 | Hajaligol | |
| 5,613,505 | A | 3/1997 | Campbell et al. | |
| 5,666,978 | A | 9/1997 | Counts et al. | |
| 5,692,525 | A | 12/1997 | Counts et al. | |
| 5,771,845 | A | 6/1998 | Pistien et al. | |
| 6,124,579 | A | 9/2000 | Steinhauser et al. | |
| 6,155,268 | A | 12/2000 | Takeuchi | |
| 6,671,450 | B2 | 12/2003 | Khan et al. | |
| 7,374,063 | B2 | 5/2008 | Reid | |
| 8,156,944 | B2 | 4/2012 | Han | |
| 8,948,578 | B2 | 2/2015 | Buchberger | |
| 9,333,229 | B2 | 5/2016 | Bjorncrantz | |
| 9,655,890 | B2 | 5/2017 | Hearn et al. | |
| 10,449,308 | B2 | 10/2019 | Buchberger | |
| 10,602,777 | B2 | 3/2020 | Dickens et al. | |
| 11,064,726 | B2 | 7/2021 | Fujisawa et al. | |
| 11,089,660 | B2 * | 8/2021 | Wensley | A24F 40/485 |
| 2001/0009660 | A1 | 7/2001 | Delli Santi et al. | |
| 2002/0113685 | A1 | 8/2002 | Izaki et al. | |
| 2003/0049025 | A1 | 3/2003 | Neumann et al. | |
| 2003/0159702 | A1 | 8/2003 | Lindell et al. | |
| 2003/0186474 | A1 | 10/2003 | Haluzak et al. | |
| 2004/0034068 | A1 | 2/2004 | Warchol et al. | |
| 2004/0096204 | A1 | 5/2004 | Gerhardinger | |
| 2004/0156792 | A1 | 8/2004 | Tarara et al. | |
| 2004/0247302 | A1 | 12/2004 | Toya et al. | |
| 2005/0063686 | A1 | 3/2005 | Whittle et al. | |
| 2005/0211711 | A1 | 9/2005 | Reid | |
| 2005/0241656 | A1 * | 11/2005 | Kennison | A24D 1/002 131/274 |
| 2005/0268911 | A1 | 12/2005 | Cross et al. | |
| 2007/0031343 | A1 * | 2/2007 | Bonfour, III | A61K 9/0078 424/45 |
| 2007/0074734 | A1 | 4/2007 | Braunshteyn et al. | |
| 2007/0155255 | A1 | 7/2007 | Galauner et al. | |
| 2007/0267033 | A1 | 11/2007 | Mishra et al. | |
| 2008/0047956 | A1 | 2/2008 | Dudman | |
| 2008/0138399 | A1 | 6/2008 | Gonda | |
| 2008/0216828 | A1 | 9/2008 | Wensley et al. | |
| 2008/0286340 | A1 | 11/2008 | Andersson et al. | |
| 2009/0126745 | A1 | 5/2009 | Hon | |
| 2009/0220222 | A1 | 9/2009 | Rabin et al. | |
| 2009/0272379 | A1 | 11/2009 | Thorens et al. | |
| 2010/0126520 | A1 | 5/2010 | Clayton | |
| 2011/0155153 | A1 | 6/2011 | Thorens et al. | |
| 2011/0226236 | A1 | 9/2011 | Buchberger | |
| 2013/0081623 | A1 | 4/2013 | Buchberger | |
| 2013/0192623 | A1 | 8/2013 | Tucker et al. | |
| 2014/0182608 | A1 | 7/2014 | Egoyants et al. | |
| 2015/0030317 | A1 | 1/2015 | Bayer et al. | |
| 2015/0040925 | A1 | 2/2015 | Saleem et al. | |
| 2015/0059780 | A1 | 3/2015 | Davis et al. | |
| 2016/0157521 | A1 | 6/2016 | Woodcock et al. | |
| 2016/0198759 | A1 * | 7/2016 | Kuntawala | A61K 47/40 131/359 |
| 2016/0338407 | A1 | 11/2016 | Kerdemelidis | |
| 2016/0345621 | A1 | 12/2016 | Li et al. | |
| 2017/0119040 | A1 | 5/2017 | Cameron | |
| 2017/0119051 | A1 | 5/2017 | Blandino et al. | |
| 2017/0215476 | A1 | 8/2017 | Dickens et al. | |
| 2017/0303594 | A1 | 10/2017 | Cameron et al. | |
| 2017/0325494 | A1 | 11/2017 | Cameron et al. | |
| 2018/0071274 | A1 | 3/2018 | Havercroft et al. | |
| 2018/0199618 | A1 | 7/2018 | Fuisz et al. | |
| 2018/0279667 | A1 | 10/2018 | McAdam et al. | |
| 2018/0279679 | A1 | 10/2018 | McAdam et al. | |
| 2018/0304031 | A1 | 10/2018 | Havercroft et al. | |
| 2019/0116863 | A1 | 4/2019 | Dull | |
| 2021/0177040 | A1 | 6/2021 | Dickens et al. | |
| 2021/0196700 | A1 * | 7/2021 | Nolan | A61K 9/0078 |
| 2021/0378282 | A1 | 12/2021 | Cabot | |
| 2021/0386110 | A1 | 12/2021 | Cabot | |
| 2021/0386111 | A1 | 12/2021 | Cabot | |
| 2022/0000167 | A1 | 1/2022 | Cabot | |
| 2022/0071267 | A1 | 3/2022 | Cabot | |
| 2022/0132906 | A1 | 5/2022 | McAdam et al. | |
| 2023/0165299 | A1 | 6/2023 | Cabot | |
| 2023/0180818 | A1 | 6/2023 | Cabot | |
| 2023/0270154 | A1 | 8/2023 | Cabot | |

FOREIGN PATENT DOCUMENTS

| | | | |
|---|---|---|---|
| AU | 2019276357 | A1 | 11/2020 |
| AU | 2019371079 | B2 | 7/2022 |
| CN | 1708241 | A | 12/2005 |
| CN | 1741789 | A | 3/2006 |
| CN | 101390659 | A | 3/2009 |
| CN | 101404902 | A | 4/2009 |
| CN | 101583354 | A | 11/2009 |
| CN | 201375023 | Y | 1/2010 |
| CN | 102753047 | A | 10/2012 |
| CN | 104585866 | A | 5/2015 |
| CN | 104970445 | A | 10/2015 |
| CN | 105029677 | A | 11/2015 |
| CN | 105979805 | A | 9/2016 |
| CN | 106413697 | A | 2/2017 |
| CN | 106572706 | A | 4/2017 |
| CN | 107105756 | A | 8/2017 |
| CN | 107529828 | A | 1/2018 |
| CN | 107949284 | A | 4/2018 |
| CN | 108289496 | A | 7/2018 |
| CN | 108323827 | A | 7/2018 |
| DE | 102015117811 | | 4/2017 |
| EP | 2110033 | A1 | 10/2009 |
| EP | 2316286 | A1 | 5/2011 |
| EP | 2340729 | A1 | 7/2011 |
| EP | 2842640 | A1 | 3/2015 |
| EP | 3574902 | | 12/2019 |
| GB | 2569940 | A | 10/2019 |
| JP | H03277265 | A | 12/1991 |
| JP | H0462094 | U | 5/1992 |
| JP | H1189551 | A | 4/1999 |
| JP | 2004298331 | A | 10/2004 |
| JP | 2005511178 | A | 4/2005 |
| JP | 2005533770 | A | 11/2005 |
| JP | 2009525746 | A | 7/2009 |
| JP | 2009537120 | A | 10/2009 |
| JP | 2010516243 | A | 5/2010 |
| JP | 2011-229481 | A | 11/2011 |
| JP | 2012210223 | A | 11/2012 |
| JP | 2014526240 | A | 10/2014 |
| JP | 2014-532437 | A | 12/2014 |
| JP | 2016073307 | A | 5/2016 |
| JP | 2016526873 | A | 9/2016 |
| JP | 2017523785 | A | 8/2017 |
| JP | 2017536816 | A | 12/2017 |
| JP | 2021523256 | A | 9/2021 |
| JP | 2021526147 | A | 9/2021 |
| JP | 2022506068 | A | 1/2022 |
| JP | 2022506094 | A | 1/2022 |
| KR | 20120101118 | A | 9/2012 |
| KR | 20160008271 | A | 1/2016 |
| NZ | 536863 | A | 5/2007 |
| RU | 2048780 | C1 | 11/1995 |
| RU | 2070062 | C1 | 12/1996 |
| RU | 2336001 | C2 | 10/2008 |
| RU | 2536115 | C2 | 12/2014 |
| RU | 2542547 | C2 | 2/2015 |
| RU | 2607535 | C2 | 1/2017 |
| RU | 2653467 | C2 | 5/2018 |
| RU | 2655188 | C2 | 5/2018 |
| RU | 2666666 | C1 | 9/2018 |
| RU | 2736854 | C1 | 11/2020 |
| WO | 1991/09599 | A1 | 7/1991 |
| WO | 0167819 | A1 | 9/2001 |
| WO | 03037412 | A2 | 5/2003 |

(56) References Cited

FOREIGN PATENT DOCUMENTS

| | | | |
|---|---|---|---|
| WO | 03049535 | A1 | 6/2003 |
| WO | 03055486 | A1 | 7/2003 |
| WO | 03101454 | A1 | 12/2003 |
| WO | 03103387 | A2 | 12/2003 |
| WO | 2004060351 | A2 | 7/2004 |
| WO | 2004076289 | A2 | 9/2004 |
| WO | 2007091181 | A2 | 8/2007 |
| WO | 2007138462 | A2 | 12/2007 |
| WO | 2008069972 | A2 | 6/2008 |
| WO | 2008069970 | A3 | 10/2008 |
| WO | 2008146543 | A1 | 12/2008 |
| WO | 2010045671 | A1 | 4/2010 |
| WO | 2010107613 | A1 | 9/2010 |
| WO | 2011045609 | A1 | 4/2011 |
| WO | 2011079932 | A1 | 7/2011 |
| WO | 2013034488 | A2 | 3/2013 |
| WO | 2013068304 | A1 | 5/2013 |
| WO | 2013161987 | A1 | 10/2013 |
| WO | 2014140320 | A1 | 9/2014 |
| WO | 2014187770 | A2 | 11/2014 |
| WO | 2015006465 | A1 | 1/2015 |
| WO | 2015009862 | A3 | 4/2015 |
| WO | 2015177252 | A1 | 11/2015 |
| WO | 2016020675 | A1 | 2/2016 |
| WO | 2016071705 | A1 | 5/2016 |
| WO | 2016096745 | A1 | 6/2016 |
| WO | 2016115250 | A1 | 7/2016 |
| WO | 2016145072 | A1 | 9/2016 |
| WO | 2017103136 | A1 | 6/2017 |
| WO | 2017175218 | A2 | 10/2017 |
| WO | 2018023890 | A1 | 2/2018 |
| WO | 2018064032 | A1 | 4/2018 |
| WO | 2019086856 | A1 | 5/2019 |
| WO | WO2019086858 | | 5/2019 |
| WO | 2020089637 | A1 | 5/2020 |
| WO | 2020089640 | A1 | 5/2020 |

OTHER PUBLICATIONS

Application and File History for U.S. Appl. No. 14/382,198, filed Aug. 29, 2014, inventors Saleem et al.

British and European Pharmacopoeia 6.0, "2.9.31 Particle Size Analysis by Laser Light Diffraction," British Pharmacopoeia Commission (2014), Stationery Office and Council of Europe (2013), pp. 311-314.

Clayton P.M., et al., "Spectroscopic Investigations into the Acid-Base Properties of Nicotine at Different Temperatures," Analytical Methods, 2013, vol. 5, pp. 81-88.

Davies, et al., "Metallic Foams: Their Production, Properties and Applications," Journal of Materials Science, 1983, vol. 18(7), pp. 1899-1911.

Examination Report No. 2 for Australian Application No. 2019370810, mailed on Jun. 15, 2022, 4 pages.

First Office Action and Search Report for Chinese Patent Application No. 2019800769594, mailed on Mar. 8, 2022, 14 pages.

First Office Action and Search Report for Chinese Patent Application No. 2019800779026, mailed on Mar. 28, 2022, 9 pages.

International Preliminary Report on Patentability for Application No. PCT/AT2011/000123, mailed Sep. 20, 2012, 6 pages.

International Preliminary Report on Patentability for Application No. PCT/GB2019/053094, mailed on Nov. 25, 2020, 6 pages.

International Search Report and Written Opinion for Application No. PCT/EP2013/057539, mailed on Feb. 11, 2014, 16 pages.

International Search Report and Written Opinion for Application No. PCT/GB2019/053092, mailed on Feb. 4, 2020, 10 pages.

International Search Report and Written Opinion for Application No. PCT/GB2019/053095, mailed on Feb. 4, 2020, 13 pages.

International Search Report and Written Opinion for PCT/GB2019/053084 date mailed Feb. 4, 2020, 13 pages.

International Search Report and Written Opinion for Application No. PCT/AT2011/000123, mailed on Jul. 18, 2011, 8 pages.

Notice of Acceptance mailed Mar. 23, 2022 for Australian Patent Application No. 2019370808, 3 pages.

Office Action mailed Sep. 29, 2015 for Japanese Application No. 2015-506185 filed Apr. 11, 2013, 5 pages.

Office Action and Search Report for Chinese Application No. 201980069806.7, mailed on Feb. 9, 2022, 20 pages.

Office Action and Search Report mailed Dec. 8, 2021 for Russian Application No. 2021112089, 15 pages.

Office Action for Chinese Application No. 201980075317.2., mailed on Feb. 23, 2022, 9 pages.

Office Action for Chinese Application No. 201980075317.2., mailed on Jun. 29, 2022, 18 pages.

Office Action for Japanese Application No. 2021-522532, mailed on Jul. 26, 2022, 10 pages.

Office Action for Japanese Application No. 2021-523220, mailed on Aug. 2, 2022, 13 pages.

Office Action for Japanese Application No. 2021-523226, mailed on Jul. 26, 2022, 13 pages.

Office Action mailed Jul. 26, 2020 for Japanese Application No. 2021-523256, 13 pages.

Search Report for Japanese Application No. 2021-522532, mailed Jul. 20, 2022, 58 pages.

Search Report for Russian Application No. 2021112009, mailed Dec. 27, 2021, 2 pages.

Search Report for Russian Application No. 2021112073 mailed on Dec. 14, 2021, 2 pages.

Search Report for Russian Application No. 2021112078 mailed on Jan. 26, 2022, 3 pages.

Search Report mailed Oct. 15, 2014 for Japanese Application No. 2012-556343, 18 pages.

Warrier M., et al., "Effect of the Porous Structure of Graphite on Atomic Hydrogen Diffusion and Inventory," Nucl. Fusion, vol. 47, 2007, pp. 1656-1663.

"Decision of Refusal received for Japanese Patent Application No. 2021-522532, mailed on Jan. 4, 2023", 8 pages (4 pages of English Translation and 4 pages of Official Copy).

"Decision of Refusal received for Japanese Patent Application No. 2021-523256, mailed on Feb. 21, 2023", 8 pages (4 pages of English Translation and 4 pages of Official Copy).

"International Preliminary Report on Patentability received for PCT Patent Application No. PCT/GB2019/053084, mailed on May 14, 2021", 8 Pages.

"International Preliminary Report on Patentability received for PCT Patent Application No. PCT/GB2019/053092, mailed on May 14, 2021", 7 Pages.

"International Preliminary Report on Patentability received for PCT Patent Application No. PCT/GB2019/053095, mailed on May 14, 2021", 7 Pages.

"Notice of Allowance received for Chinese Patent Application No. 201980076959.4, mailed on Sep. 5, 2022", 6 pages (2 pages of English Translation and 4 pages of Official Copy).

"Notice of Reasons for Refusal received for Japanese Patent Application No. 2021-523226 mailed on Feb. 21, 2023", 8 pages (4 pages of English Translation and 4 pages of Official Copy).

"Office Action received for Canadian Patent Application No. 3,118,059, mailed on Jun. 15, 2023", 5 pages.

"Report of Reconsideration by Examiner before Appeal for Japanese Patent Application No. 2021-522532, dated Jun. 13, 2023", 5 pages (2 pages of English Translation and 3 pages of Official Copy).

Bair, W. J., et al., The Report of a Task Group Committee 2, the Human Respiratory Tract Model, Annals of the ICRP, ICRP Publication 66, 1994, 492 pages, vol. 24, Nos. 1-3, Pergamon Press ISSN 0146-6453.

Shekunov, B.Y., et al., Particle Size Analysis in Pharmaceutics: Principles, Methods and Applications, Feb. 2007, 25 pages, vol. 24, Pharmaceutical Research, DOI: 10.1007/s111095-006-9146-7, Springer Science+Business Media, Inc.

Martin, A.R., et al., Nebulizers for Drug Delivery to the Lungs: Expert Opinion on Drug Delivery, abstract only, Dec. 23, 2014, 4 pages, Taylor & Francis Online, London, United Kingdom.

Non-Final Office Action, U.S. Appl. No. 14/927,556, dated Dec. 27, 2017, 9 pages, U.S. Patent and Trademark Office, Alexandria, Virginia.

(56) References Cited

OTHER PUBLICATIONS

Shekunov et al., "Particle Size Analysis in Pharmaceutics: Principles, Methods and Applications", Pharmaceutical Research, vol. 24, No. 2, pp. 203-227, Feb. 2007 DOI: 10.1007/s11095-006-9146-7.

A. R. Martin and W.H. Finlay, "Nebulizers for drug delivery to the lungs", Expert Opinion on Drug Delivery, vol. 12, No. 6, pp. 889-900, Dec. 2014 DOI:10.1517/17425247.2015.995087.

* cited by examiner

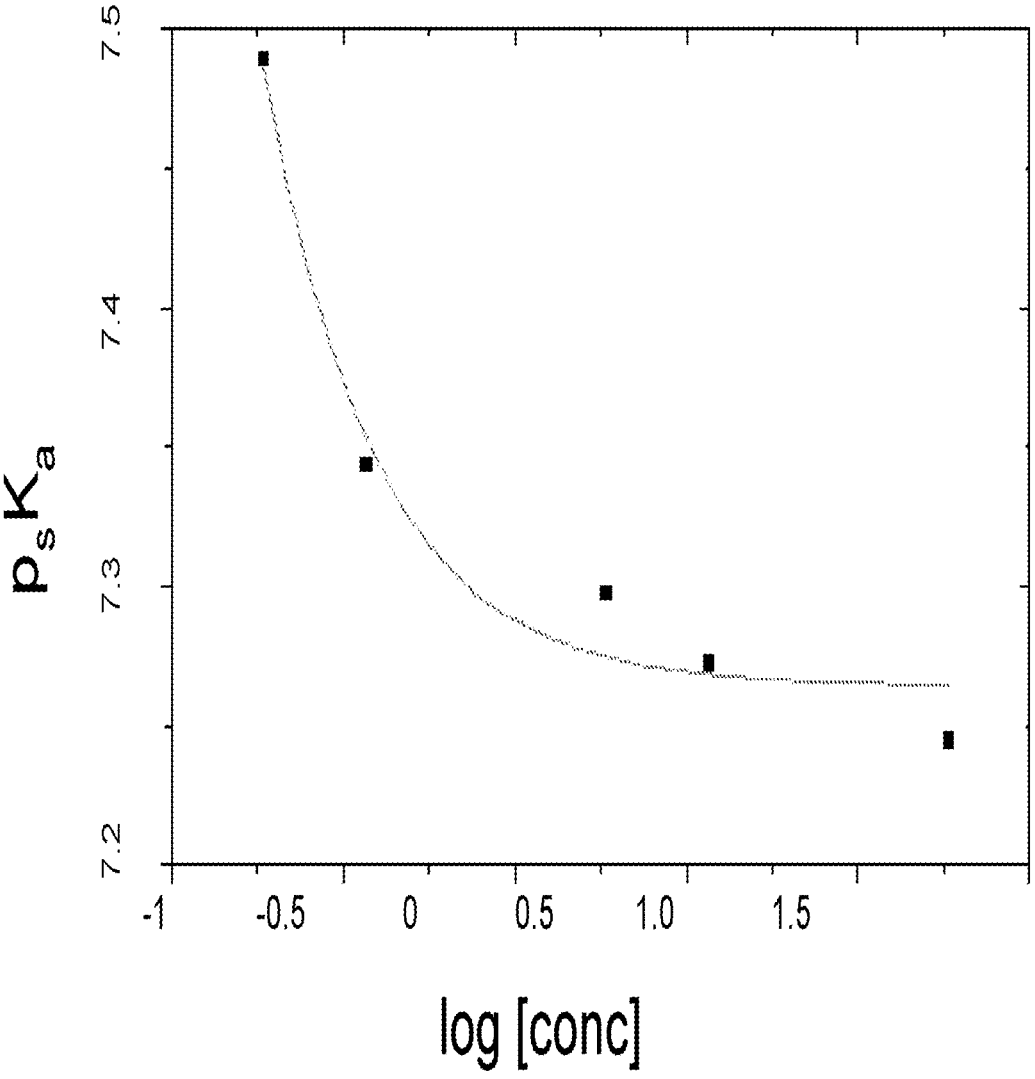
7.5
7.4
7.3
7.2
$p_sK_a$
-1
-0.5
0
0.5
1.0
1.5
log [conc]

AEROSOLIZED FORMULATION

PRIORITY CLAIM

The present application is a National Phase entry of PCT Application No. PCT/GB2019/053094, filed Oct. 31, 2019 which claims priority from GB Patent Application No. 1817860.8 filed Nov. 1, 2018.

FIELD OF THE INVENTION

The present disclosure relates to an aerosolized formulation, a method of forming the same, a device for forming the same and processes and uses of the same.

BACKGROUND TO THE INVENTION

Electronic aerosol provision systems such as e-cigarettes generally contain a reservoir of liquid which is to be vaporized, typically containing a flavor or an active agent such as nicotine. When a user inhales on the device, a heater is activated to vaporize a small amount of liquid, which is therefore inhaled by the user.

The use of e-cigarettes in the UK has grown rapidly, and it has been estimated that there are now over a million people using them in the UK.

One challenge faced in providing such systems is to provide from the aerosol provision device an aerosol to be inhaled which provides consumers with an acceptable experience. Some consumers may prefer an e-cigarette that generates an aerosol that closely 'mimics' smoke inhaled from a tobacco product such as a cigarette. Aerosols from e-cigarettes and smoke from tobacco products such as cigarettes provides to the user a complex chain of flavor in the mouth, and if nicotine is present, nicotine absorption in the mouth and throat, followed by nicotine absorption in the lungs. These various aspects are described by users in terms of flavor, intensity/quality, impact, irritation/smoothness and reward. Flavor contributes to a number of these factors, and is strongly associated with flavor in the mouth and the provision of desirable taste and smell, whether mimicking the taste and smell of a tobacco product or providing alternative flavors. Reliably providing a particular taste and smell is made more difficult by the volatile and thermally sensitive nature of some flavors. Heating of flavor components in e-cigarettes may result in some flavors being degraded. This has a number of disadvantages. Flavors present in the liquid may be lost resulting in a diminished flavor experience for the user or the need to include in the liquid excess flavor at additional cost. Furthermore if e-liquid contains multiple flavors and only some of these multiple flavors are degraded, this can adversely affect the balance of the taste and smell. Furthermore, degraded flavors may have an undesirable or "off taste". Each of these factors, and their balance, can strongly contribute to consumer acceptability of an e-cigarette. Providing means to optimize the overall vaping experience is therefore desirable to e-cigarette manufacturers.

A further challenge facing such systems is the continued demand for harm reduction. Harm from cigarette and e-cigarette devices primarily comes from toxicants. Therefore, there is a desire to reduce the potential for the formation of toxicants.

SUMMARY OF THE INVENTION

In one aspect there is provided an aerosolized formulation comprising (i) water in an amount of at least 50 wt. % based on the aerosolized formulation; and (ii) at least one flavor;

wherein the aerosolized formulation contains the at least one flavor in an amount of at least 70 wt % of the said flavor present in the aerosolizable formulation from which the aerosolized formulation was formed.

In one aspect there is provided a process for forming an aerosol, the process comprising aerosolizing an aerosolizable formulation comprising (i) water in an amount of at least 50 wt. % based on the aerosolized formulation; and (ii) at least one flavor;

to provide an aerosol containing the at least one flavor in an amount of at least 70 wt % of the said flavor present in the aerosolizable formulation.

In one aspect there is provided an electronic aerosol provision system comprising:

(a) an aerosolizer for aerosolizing formulation for inhalation by a user of the electronic aerosol provision system;

(b) a power supply comprising a cell or battery for supplying power to the aerosolizer (c) aerosolizable formulation comprising (i) water in an amount of at least 50 wt. % based on the aerosolized formulation; and (ii) at least one flavor;

wherein the aerosolizer provides an aerosol containing the at least one flavor in an amount of at least 70 wt % of the said flavor present in the aerosolizable formulation.

In one aspect there is provided a process for improving delivery of flavor to an aerosolized formulation, the process comprising the steps of (a) providing an aerosolizable material comprising (i) water in an amount of at least 50 wt. % based on the aerosolizable material and (ii) at least one flavor;

(b) aerosolizing the material aerosolizable material to provide an aerosol containing the at least one flavor in an amount of at least 70 wt % of the said flavor present in the aerosolizable formulation.

BRIEF DESCRIPTION OF THE DRAWINGS

The present invention will now be described in further detail by way of example only with reference to the accompanying FIGURE which shows a graph illustrating variation of $p_sK_a2$ with nicotine concentration.

DETAILED DESCRIPTION

As discussed herein in one aspect there is provided an aerosolized formulation comprising (i) water in an amount of at least 50 wt. % based on the aerosolized formulation; and (ii) at least one flavor;

wherein the aerosolized formulation contains the at least one flavor in an amount of at least 70 wt % of the said flavor present in the aerosolizable formulation from which the aerosolized formulation was formed.

We have found that an advantageous system may be provided which an aerosolized formulation containing a high content of water and a flavor is formed from an aerosolizable formulation. The use of a system containing at least 50 wt % water 'protects' the flavor from degradation by heat and in particular allows for the formation of an aerosolized formulation at a low temperature. This is in contrast to 'traditional' e-cigarettes which use a heater, typically applied to liquids based on glycerol and propylene glycol to form an aerosolized formulation.

For ease of reference, these and further aspects of the present invention are now discussed under appropriate section headings. However, the teachings under each section are not necessarily limited to each particular section.

Water

As discussed herein the aerosolized formulation comprises water in an amount of at least 50 wt. % based on the aerosolized formulation. In one aspect water is present in an amount of at least 55 wt. % based on the aerosolized formulation. In one aspect water is present in an amount of at least 60 wt. % based on the aerosolized formulation. In one aspect water is present in an amount of at least 65 wt. % based on the aerosolized formulation. In one aspect water is present in an amount of at least 70 wt. % based on the aerosolized formulation. In one aspect water is present in an amount of at least 75 wt. % based on the aerosolized formulation. In one aspect water is present in an amount of at least 80 wt. % based on the aerosolized formulation. In one aspect water is present in an amount of at least 85 wt. % based on the aerosolized formulation. In one aspect water is present in an amount of at least 90 wt. % based on the aerosolized formulation. In one aspect water is present in an amount of at least 95 wt. % based on the aerosolized formulation. In one aspect water is present in an amount of at least 99 wt. % based on the aerosolized formulation.

In one aspect water is present in an amount of from 50 to 99 wt. % based on the aerosolized formulation. In one aspect water is present in an amount of from 55 to 99 wt. % based on the aerosolized formulation. In one aspect water is present in an amount of from 60 to 99 wt. % based on the aerosolized formulation. In one aspect water is present in an amount of from 65 to 99 wt. % based on the aerosolized formulation. In one aspect water is present in an amount of from 70 to 99 wt. % based on the aerosolized formulation. In one aspect water is present in an amount of from 75 to 99 wt. % based on the aerosolized formulation. In one aspect water is present in an amount of from 80 to 99 wt. % based on the aerosolized formulation. In one aspect water is present in an amount of from 85 to 99 wt. % based on the aerosolized formulation. In one aspect water is present in an amount of from 90 to 99 wt. % based on the aerosolized formulation. In one aspect water is present in an amount of from 95 to 99 wt. % based on the aerosolized formulation.

As discussed herein the aerosolizable formulation comprises water in an amount of at least 50 wt. % based on the aerosolizable formulation. In one aspect water is present in an amount of at least 55 wt. % based on the aerosolizable formulation. In one aspect water is present in an amount of at least 60 wt. % based on the aerosolizable formulation. In one aspect water is present in an amount of at least 65 wt. % based on the aerosolizable formulation. In one aspect water is present in an amount of at least 70 wt. % based on the aerosolizable formulation. In one aspect water is present in an amount of at least 75 wt. % based on the aerosolizable formulation. In one aspect water is present in an amount of at least 80 wt. % based on the aerosolizable formulation. In one aspect water is present in an amount of at least 85 wt. % based on the aerosolizable formulation. In one aspect water is present in an amount of at least 90 wt. % based on the aerosolizable formulation. In one aspect water is present in an amount of at least 95 wt. % based on the aerosolizable formulation. In one aspect water is present in an amount of at least 99 wt. % based on the aerosolizable formulation.

In one aspect water is present in an amount of from 50 to 99 wt. % based on the aerosolizable formulation. In one aspect water is present in an amount of from 55 to 99 wt. % based on the aerosolizable formulation. In one aspect water is present in an amount of from 60 to 99 wt. % based on the aerosolizable formulation. In one aspect water is present in an amount of from 65 to 99 wt. % based on the aerosolizable formulation. In one aspect water is present in an amount of from 70 to 99 wt. % based on the aerosolizable formulation. In one aspect water is present in an amount of from 75 to 99 wt. % based on the aerosolizable formulation. In one aspect water is present in an amount of from 80 to 99 wt. % based on the aerosolizable formulation. In one aspect water is present in an amount of from 85 to 99 wt. % based on the aerosolizable formulation. In one aspect water is present in an amount of from 90 to 99 wt. % based on the aerosolizable formulation. In one aspect water is present in an amount of from 95 to 99 wt. % based on the aerosolizable formulation.

As discussed herein the use of water allows for the replacement of some or all of the glycerol, propylene glycol, 1,3-propane diol and mixtures thereof typically used in e-cigarettes. In one aspect the aerosolizable formulation contains glycerol, propylene glycol, 1,3-propane diol and mixtures thereof in a combined amount of no greater than 10 wt. % based on the aerosolizable formulation or based on the aerosolized formulation. In one aspect the aerosolizable formulation contains glycerol, propylene glycol, 1,3-propane diol and mixtures thereof in a combined amount of no greater than 8 wt. % based on the aerosolizable formulation or based on the aerosolized formulation. In one aspect the aerosolizable formulation contains glycerol, propylene glycol, 1,3-propane diol and mixtures thereof in a combined amount of no greater than 5 wt. % based on the aerosolizable formulation or based on the aerosolized formulation. In one aspect the aerosolizable formulation contains glycerol, propylene glycol, 1,3-propane diol and mixtures thereof in a combined amount of no greater than 2 wt. % based on the aerosolizable formulation or based on the aerosolized formulation. In one aspect the aerosolizable formulation contains glycerol, propylene glycol, 1,3-propane diol and mixtures thereof in a combined amount of no greater than 1 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.5 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.2 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.1 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.01 wt. % based on the aerosolizable formulation or based on the aerosolized formulation. In one aspect the aerosolizable formulation contains no glycerol, propylene glycol, 1,3-propane diol and mixtures thereof.

In one aspect the aerosolizable formulation contains glycerol, propylene glycol, and mixtures thereof in a combined amount of no greater than 10 wt. % based on the aerosolizable formulation or based on the aerosolized formulation. In one aspect the aerosolizable formulation contains glycerol, propylene glycol, and mixtures thereof in a combined amount of no greater than 8 wt. % based on the aerosolizable formulation or based on the aerosolized formulation. In one aspect the aerosolizable formulation contains glycerol, propylene glycol, and mixtures thereof in a combined amount of no greater than 5 wt. % based on the aerosolizable formulation or based on the aerosolized formulation. In one aspect the aerosolizable formulation contains glycerol, propylene glycol, and mixtures thereof in a combined amount of no greater than 2 wt. % based on the aerosolizable formulation or based on the aerosolized formulation. In one aspect the aerosolizable formulation contains glycerol, propylene glycol, and mixtures thereof in a combined amount of no greater than 1 wt. % based on the aerosolizable formulation or based on the aerosolized formulation. In one aspect the aerosolizable formulation contains glycerol, propylene glycol, and mixtures thereof in a combined amount of no greater than 0.5 wt. % based on the aerosolizable formulation or based on the aerosolized formulation. In one aspect the aerosolizable formulation contains glycerol, propylene glycol, and mixtures thereof in a combined amount of no greater than 0.2 wt. % based on the aerosolizable formulation or based on the aerosolized formulation. In one aspect the aerosolizable formulation contains glycerol, propylene glycol, and mixtures thereof in a combined amount of no greater than 0.1 wt. % based on the aerosolizable formulation or based on the aerosolized formulation. In one aspect the aerosolizable formulation contains glycerol, propylene glycol, and mixtures thereof in a combined amount of no greater than 0.01 wt. % based on the aerosolizable formulation or based on the aerosolized formulation. In one aspect the aerosolizable formulation contains no glycerol, propylene glycol, and mixtures thereof.

In one aspect the aerosolizable formulation contains glycerol in an amount of no greater than 10 wt. % based on the aerosolizable formulation or based on the aerosolized formulation. In one aspect the aerosolizable formulation contains glycerol in an amount of no greater than 8 wt. % based on the aerosolizable formulation or based on the aerosolized formulation. In one aspect the aerosolizable formulation contains glycerol in an amount of no greater than 5 wt. % based on the aerosolizable formulation or based on the aerosolized formulation. In one aspect the aerosolizable formulation contains glycerol in an amount of no greater than 2 wt. % based on the aerosolizable formulation or based on the aerosolized formulation. In one aspect the aerosolizable formulation contains glycerol in an amount of no greater than 1 wt. % based on the aerosolizable formulation or based on the aerosolized formulation. In one aspect the aerosolizable formulation contains glycerol in an amount of no greater than 0.5 wt. % based on the aerosolizable formulation or based on the aerosolized formulation. In one aspect the aerosolizable formulation contains glycerol in an amount of no greater than 0.2 wt. % based on the aerosolizable formulation or based on the aerosolized formulation. In one aspect the aerosolizable formulation contains glycerol in an amount of no greater than 0.1 wt. % based on the aerosolizable formulation or based on the aerosolized formulation. In one aspect the aerosolizable formulation contains glycerol in an amount of no greater than 0.01 wt. % based on the aerosolizable formulation or based on the aerosolized formulation. In one aspect the aerosolizable formulation contains no glycerol.

In one aspect the aerosolizable formulation contains propylene glycol in an amount of no greater than 10 wt. % based on the aerosolizable formulation or based on the aerosolized formulation. In one aspect the aerosolizable formulation contains propylene glycol in an amount of no greater than 8 wt. % based on the aerosolizable formulation or based on the aerosolized formulation. In one aspect the aerosolizable formulation contains propylene glycol in an amount of no greater than 5 wt. % based on the aerosolizable formulation or based on the aerosolized formulation. In one aspect the aerosolizable formulation contains propylene glycol in an amount of no greater than 2 wt. % based on the aerosolizable formulation or based on the aerosolized formulation. In one aspect the aerosolizable formulation contains propylene glycol in an amount of no greater than 1 wt. % based on the aerosolizable formulation or based on the aerosolized formulation. In one aspect the aerosolizable formulation contains propylene glycol in an amount of no greater than 0.5 wt. % based on the aerosolizable formulation or based on the aerosolized formulation. In one aspect the aerosolizable formulation contains propylene glycol in an amount of no greater than 0.2 wt. % based on the aerosolizable formulation or based on the aerosolized formulation. In one aspect the aerosolizable formulation contains propylene glycol in an amount of no greater than 0.1 wt. % based on the aerosolizable formulation or based on the aerosolized formulation. In one aspect the aerosolizable formulation contains propylene glycol in an amount of no greater than 0.01 wt. % based on the aerosolizable formulation or based on the aerosolized formulation. In one aspect the aerosolizable formulation contains no propylene glycol.

Flavor

As discussed herein, the aerosolized formulation contains at least one flavor in an amount of at least 70 wt % of the said flavor present in the aerosolizable formulation from which the aerosolized formulation was formed. In one aspect, the aerosolized formulation contains at least one flavor in an amount of at least 75 wt % of the said flavor present in the aerosolizable formulation from which the aerosolized formulation was formed. In one aspect, the aerosolized formulation contains at least one flavor in an amount of at least 80 wt % of the said flavor present in the aerosolizable formulation from which the aerosolized formulation was formed. In one aspect, the aerosolized formulation contains at least one flavor in an amount of at least 85 wt % of the said flavor present in the aerosolizable formulation from which the aerosolized formulation was formed. In one aspect, the aerosolized formulation contains at least one flavor in an amount of at least 90 wt % of the said flavor present in the aerosolizable formulation from which the aerosolized formulation was formed. In one aspect, the aerosolized formulation contains at least one flavor in an amount of at least 95 wt % of the said flavor present in the aerosolizable formulation from which the aerosolized formulation was formed. In one aspect, the aerosolized formulation contains at least one flavor in an amount of at least 98 wt % of the said flavor present in the aerosolizable formulation from which the aerosolized formulation was formed. In one aspect, the aerosolized formulation contains at least one flavor in an amount of at least 99 wt % of the said flavor present in the aerosolizable formulation from which the aerosolized formulation was formed.

In one aspect the aerosolized formulation contains more than one flavor. In one aspect, when the aerosolized formulation contains a plurality of flavors, the aerosolized formulation each of the plurality of flavors in an amount of at least 70 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 75 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 80 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 85 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 90 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 95 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 98 wt % of the said flavor present in the aerosolizable formulation from which the aerosolized formulation was formed. In one aspect, when the aerosolized formulation contains a plurality of flavors, the aerosolized formulation each of the plurality of flavors in an amount of at least 99 wt % of the said flavor present in the aerosolizable formulation from which the aerosolized formulation was formed.

The aerosolizable formulation comprises one or more flavors or flavoring components. As used herein, the terms "flavor" and "flavorant" refer to materials which, where local regulations permit, may be used to create a desired taste or aroma in a product for adult consumers. They may include extracts (e.g. liquorice, *hydrangea*, Japanese white bark *magnolia* leaf, chamomile, fenugreek, clove, menthol, Japanese mint, aniseed, cinnamon, herb, wintergreen, cherry, berry, peach, apple, liqueur (for example, Drambuie®), bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The one or more flavors may be selected from the group consisting of (4-(para-) methoxyphenyl)-2-butanone, vanillin, γ-undecalactone, menthone, 5-propenyl guaethol, menthol, para-*mentha*-8-thiol-3-one and mixtures thereof. In one aspect the flavor is at least menthol.

If present, the one or more flavors may be present in any suitable amount. In one aspect the one or more flavors are present in a total amount of no greater than 10 wt. % based on the aerosolizable formulation. In one aspect the one or more flavors are present in a total amount of no greater than 7 wt. % based on the aerosolizable formulation. In one aspect the one or more flavors are present in a total amount of no greater than 5 wt. % based on the aerosolizable formulation. In one aspect the one or more flavors are present in a total amount of no greater than 4 wt. % based on the aerosolizable formulation. In one aspect the one or more flavors are present in a total amount of no greater than 3 wt. % based on the aerosolizable formulation. In one aspect the one or more flavors are present in a total amount of no greater than 2 wt. % based on the aerosolizable formulation. In one aspect the one or more flavors are present in a total amount of no greater than 1 wt. % based on the aerosolizable formulation.

In one aspect the one or more flavors are present in a total amount of from 0.01 to 5 wt. % based on the aerosolizable formulation. In one aspect the one or more flavors are present in a total amount of from 0.01 to 4 wt. % based on the aerosolizable formulation. In one aspect the one or more flavors are present in a total amount of from 0.01 to 3 wt. % based on the aerosolizable formulation. In one aspect the one or more flavors are present in a total amount of from 0.01 to 2 wt. % based on the aerosolizable formulation. In one aspect the one or more flavors are present in a total amount of from 0.01 to 1 wt. % based on the aerosolizable formulation. In one aspect the one or more flavors are present in a total amount of from 0.01 to 0.5 wt. % based on the aerosolizable formulation.

In one aspect the one or more flavors are present in a total amount of no greater than 10 wt. % based on the aerosolized formulation. In one aspect the one or more flavors are present in a total amount of no greater than 7 wt. % based on the aerosolized formulation. In one aspect the one or more flavors are present in a total amount of no greater than 5 wt. % based on the aerosolized formulation. In one aspect the one or more flavors are present in a total amount of no greater than 4 wt. % based on the aerosolized formulation. In one aspect the one or more flavors are present in a total amount of no greater than 3 wt. % based on the aerosolized formulation. In one aspect the one or more flavors are present in a total amount of no greater than 2 wt. % based on the aerosolized formulation. In one aspect the one or more flavors are present in a total amount of no greater than 1 wt. % based on the aerosolized formulation.

In one aspect the one or more flavors are present in a total amount of from 0.01 to 5 wt. % based on the aerosolized formulation. In one aspect the one or more flavors are present in a total amount of from 0.01 to 4 wt. % based on the aerosolized formulation. In one aspect the one or more flavors are present in a total amount of from 0.01 to 3 wt. % based on the aerosolized formulation. In one aspect the one or more flavors are present in a total amount of from 0.01 to 2 wt. % based on the aerosolized formulation. In one aspect the one or more flavors are present in a total amount of from 0.01 to 1 wt. % based on the aerosolized formulation. In one aspect the one or more flavors are present in a total amount of from 0.01 to 0.5 wt. % based on the aerosolized formulation.

Active Agent

The aerosolizable formulation and the aerosolized formulation of the present invention may contain one or more further components. These components may be selected depending on the nature of the formulation. In one aspect, the aerosolizable formulation and the aerosolized formulation further comprises an active agent. By "active agent" it is meant an agent which has a biological effect on a subject when the aerosol is inhaled. The active agent may for example be selected from nutraceuticals, nootropics, psychoactives. The active substance may be naturally occurring or synthetically obtained. The active agent may comprise for example nicotine, caffeine, taurine, thiene, vitamins such as B6 or B12 or C, melatonin, cannabinoids, or constituents, derivatives, or combinations thereof. The active agent may comprise one or more constituents, derivatives or extracts of tobacco, *cannabis* or another botanical. In some embodiments, the active agent comprises caffeine, melatonin or vitamin B12. The one or more active agents may be selected from nicotine, botanicals, and mixtures thereof. The one or more active agents may be of synthetic or natural origin. The active could be an extract from a botanical, such as from a plant in the tobacco family. An example active is nicotine.

As noted herein, the active agent may comprise one or more constituents, derivatives or extracts of *cannabis*, such as one or more cannabinoids or terpenes. Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as *cannabis*, from animals (endocannabinoids), or artificially manufactured (synthetic cannabinoids). *Cannabis* species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in *cannabis* include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

In some embodiments, the active agent comprises one or more constituents, derivatives or extracts of *cannabis*.

As noted herein, the active agent may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita* citrata c.v., *Mentha piperita* c.v, *Mentha spicata* crispa, *Mentha* cardifolia, *Mentha longifolia, Mentha suaveolens* variegata, *Mentha pulegium, Mentha spicata* c.v. and *Mentha suaveolens*

In some embodiments, the active agent comprises or derived from one or more botanicals or constituents, derivatives or extracts thereof and the botanical is tobacco.

In some embodiments, the active agent comprises or derived from one or more botanicals or constituents, derivatives or extracts thereof and the botanical is selected from *eucalyptus*, star anise, cocoa and hemp.

In some embodiments, the active agent comprises or derived from one or more botanicals or constituents, derivatives or extracts thereof and the botanical is selected from rooibos and fennel.

In one aspect the one or more active agents are present in a combined amount (such as nicotine is present in an amount) of no greater than 6 wt % based on the aerosolizable formulation or based on the aerosolized formulation. In one aspect the one or more active agents are present in a combined amount (such as nicotine is present in an amount) of from 0.01 to 6 wt % based on the aerosolizable formulation or based on the aerosolized formulation. In one aspect the one or more active agents are present in a combined amount (such as nicotine is present in an amount) of from 0.02 to 6 wt % based on the aerosolizable formulation or based on the aerosolized formulation. In one aspect the one or more active agents are present in a combined amount (such as nicotine is present in an amount) of from 0.05 to 6 wt % based on the aerosolizable formulation or based on the aerosolized formulation. In one aspect the one or more active agents are present in a combined amount (such as nicotine is present in an amount) of from 0.08 to 6 wt % based on the aerosolizable formulation or based on the aerosolized formulation. In one aspect the one or more active agents are present in a combined amount (such as nicotine is present in an amount) of from 0.01 to 5 wt % based on the aerosolizable formulation or based on the aerosolized formulation. In one aspect the one or more active agents are present in a combined amount (such as nicotine is present in an amount) of from 0.02 to 5 wt % based on the aerosolizable formulation or based on the aerosolized formulation. In one aspect the one or more active agents are present in a combined amount (such as nicotine is present in an amount) of from 0.05 to 5 wt % based on the aerosolizable formulation or based on the aerosolized formulation. In one aspect the one or more active agents are present in a combined amount (such as nicotine is present in an amount) of from 0.08 to 5 wt % based on the aerosolizable formulation or based on the aerosolized formulation. In one aspect the one or more active agents are present in a combined amount (such as nicotine is present in an amount) of no greater than 4 wt % based on the aerosolizable formulation or based on the aerosolized formulation. In one aspect the one or more active agents are present in a combined amount (such as nicotine is present in an amount) of from 0.01 to 4 wt % based on the aerosolizable formulation or based on the aerosolized formulation. In one aspect the one or more active agents are present in a combined amount (such as nicotine is present in an amount) of from 0.02 to 4 wt % based on the aerosolizable formulation or based on the aerosolized formulation. In one aspect the one or more active agents are present in a combined amount (such as nicotine is present in an amount) of from 0.05 to 4 wt % based on the aerosolizable formulation or based on the aerosolized formulation. In one aspect the one or more active agents are present in a combined amount (such as nicotine is present in an amount) of from 0.08 to 4 wt % based on the aerosolizable formulation or based on the aerosolized formulation. In one aspect the one or more active agents are present in a combined amount (such as nicotine is present in an amount) of no greater than 3 wt % based on the aerosolizable formulation or based on the aerosolized formulation. In one aspect the one or more active agents are present in a combined amount (such as nicotine is present in an amount) of from 0.01 to 3 wt % based on the aerosolizable formulation or based on the aerosolized formulation. In one aspect the one or more active agents are present in a combined amount (such as nicotine is present in an amount) of from 0.02 to 3 wt % based on the aerosolizable formulation or based on the aerosolized formulation. In one aspect the one or more active agents are present in a combined amount (such as nicotine is present in an amount) of from 0.05 to 3 wt % based on the aerosolizable formulation or based on the aerosolized formulation. In one aspect the one or more active agents are present in a combined amount (such as nicotine is present in an amount) of from 0.08 to 3 wt % based on the aerosolizable formulation or based on the aerosolized formulation. In one aspect the one or more active agents are present in a combined amount (such as nicotine is present in an amount) of no greater than 2 wt % based on the aerosolizable formulation or based on the aerosolized formulation. In one aspect the one or more active agents are present in a combined amount (such as nicotine is present in an amount) of from 0.01 to 2 wt % based on the aerosolizable formulation or based on the aerosolized formulation. In one aspect the one or more active agents are present in a combined amount (such as nicotine is present in an amount) of from 0.02 to 2 wt % based on the aerosolizable formulation or based on the aerosolized formulation. In one aspect the one or more active agents are present in a combined amount (such as nicotine is present in an amount) of from 0.05 to 2 wt % based on the aerosolizable formulation or based on the aerosolized formulation. In one aspect the one or more active agents are present in a combined amount (such as nicotine is present in an amount) of from 0.08 to 2 wt % based on the aerosolizable formulation or based on the aerosolized formulation. In one aspect the one or more active agents are present in a combined amount (such as nicotine is present in an amount) of no greater than 1 wt % based on the aerosolizable formulation or based on the aerosolized formulation. In one aspect the one or more active agents are present in a combined amount (such as nicotine is present in an amount) of from 0.01 to 1 wt % based on the aerosolizable formulation or based on the aerosolized formulation. In one aspect the one or more active agents are present in a combined amount (such as nicotine is present in an amount) of from 0.02 to 1 wt % based on the aerosolizable formulation or based on the aerosolized formulation. In one aspect the one or more active agents are present in a combined amount (such as nicotine is present in an amount) of from 0.05 to 1 wt % based on the aerosolizable formulation or based on the aerosolized formulation. In one aspect the one or more active agents are present in a combined amount (such as nicotine is present in an amount) of from 0.08 to 1 wt % based on the aerosolizable formulation or based on the aerosolized formulation. In one aspect the one or more active agents are present in a combined amount (such as nicotine is present in an amount) of from 0.1 to 1 wt % based on the aerosolizable formulation or based on the aerosolized formulation. In one aspect the one or more active agents are present in a combined amount (such as nicotine is present in an amount) of no greater than 0.6 wt % based on the aerosolizable formulation or based on the aerosolized formulation. In one aspect the one or more active agents are present in a combined amount (such as nicotine is present in an amount) of from 0.01 to 0.6 wt % based on the aerosolizable formulation or based on the aerosolized formulation. In one aspect the one or more active agents are present in a combined amount (such as nicotine is present in an amount) of from 0.02 to 0.6 wt % based on the aerosolizable formulation or based on the aerosolized formulation. In one aspect the one or more active agents are present in a combined amount (such as nicotine is present in an amount) of from 0.05 to 0.6 wt % based on the aerosolizable formulation or based on the aerosolized formulation. In one aspect the one or more active agents are present in a combined amount (such as nicotine is present in an amount) of from 0.08 to 0.6 wt % based on the aerosolizable formulation or based on the aerosolized formulation. In one aspect the one or more active agents are present in a combined amount (such as nicotine is present in an amount) of from 0.1 to 0.6 wt % based on the aerosolizable formulation or based on the aerosolized formulation. In one aspect the one or more active agents are present in a combined amount (such as nicotine is present in an amount) of no greater than 0.5 wt % based on the aerosolizable formulation or based on the aerosolized formulation. In one aspect the one or more active agents are present in a combined amount (such as nicotine is present in an amount) of from 0.01 to 0.5 wt % based on the aerosolizable formulation or based on the aerosolized formulation. In one aspect the one or more active agents are present in a combined amount (such as nicotine is present in an amount) of from 0.02 to 0.5 wt % based on the aerosolizable formulation or based on the aerosolized formulation. In one aspect the one or more active agents are present in a combined amount (such as nicotine is present in an amount) of from 0.05 to 0.5 wt % based on the aerosolizable formulation or based on the aerosolized formulation. In one aspect the one or more active agents are present in a combined amount (such as nicotine is present in an amount) of from 0.08 to 0.5 wt % based on the aerosolizable formulation or based on the aerosolized formulation. In one aspect the one or more active agents are present in a combined amount (such as nicotine is present in an amount) of no greater than 0.2 wt % based on the aerosolizable formulation or based on the aerosolized formulation. In one aspect the one or more active agents are present in a combined amount (such as nicotine is present in an amount) of from 0.01 to 0.2 wt % based on the aerosolizable formulation or based on the aerosolized formulation. In one aspect the one or more active agents are present in a combined amount (such as nicotine is present in an amount) of from 0.02 to 0.2 wt % based on the aerosolizable formulation or based on the aerosolized formulation. In one aspect the one or more active agents are present in a combined amount (such as nicotine is present in an amount) of from 0.05 to 0.2 wt % based on the aerosolizable formulation or based on the aerosolized formulation. In one aspect the one or more active agents are present in a combined amount (such as nicotine is present in an amount) of from 0.08 to 0.2 wt % based on the aerosolizable formulation or based on the aerosolized formulation. In one aspect the one or more active agents are present in a combined amount (such as nicotine is present in an amount) of no greater than 0.1 wt % based on the aerosolizable formulation or based on the aerosolized formulation. In one aspect the one or more active agents are present in a combined amount (such as nicotine is present in an amount) of from 0.01 to 0.1 wt % based on the aerosolizable formulation or based on the aerosolized formulation. In one aspect the one or more active agents are present in a combined amount (such as nicotine is present in an amount) of from 0.02 to 0.1 wt % based on the aerosolizable formulation or based on the aerosolized formulation. In one aspect the one or more active agents are present in a combined amount (such as nicotine is present in an amount) of from 0.05 to 0.1 wt % based on the aerosolizable formulation or based on the aerosolized formulation. In one aspect the one or more active agents are present in a combined amount (such as nicotine is present in an amount) of from 0.08 to 0.1 wt % based on the aerosolizable formulation or based on the aerosolized formulation.

Acid

As discussed above, the aerosolizable formulation and the aerosolized formulation of the present invention may contain one or more further components. These components may be selected depending on the nature of the formulation. In one aspect, the aerosolizable formulation and the aerosolized formulation further comprises an acid.

In one aspect the acid is an organic acid. In one aspect the acid is a carboxylic acid. In one aspect the acid is an organic carboxylic acid.

In one aspect the acid is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof. In one aspect the acid is selected from the group consisting of citric acid, benzoic acid, levulinic acid, lactic acid, sorbic acid, and mixtures thereof. In one aspect the acid is selected from the group consisting of citric acid, benzoic acid, levulinic acid, and mixtures thereof. In one aspect the acid is at least citric acid. In one aspect the acid consists of citric acid.

In one aspect the acid is selected from acids having a pKa of from 2 to 5. In one aspect the acid is a weak acid. In one aspect the acid is a weak organic acid.

In one aspect the acid has a solubility in water of at least 5 g/L at 20° C. In one aspect the acid has a solubility in water of at least 10 g/L at 20° C. In one aspect the acid has a solubility in water of at least 20 g/L at 20° C. In one aspect the acid has a solubility in water of at least 50 g/L at 20° C. In one aspect the acid has a solubility in water of at least 100 g/L at 20° C. In one aspect the acid has a solubility in water of at least 200 g/L at 20° C. In one aspect the acid has a solubility in water of at least 300 g/L at 20° C. In one aspect the acid has a solubility in water of at least 400 g/L at 20° C. In one aspect the acid has a solubility in water of at least 500 g/L at 20° C. In one aspect the acid has a solubility in water of at least 600 g/L at 20° C. In one aspect the acid has a solubility in water of at least 700 g/L at 20° C. In one aspect the acid has a solubility in water of at least 800 g/L at 20° C. In one aspect the acid has a solubility in water of at least 900 g/L at 20° C. In one aspect the acid has a solubility in water of at least 1000 g/L at 20° C. In one aspect the acid has a solubility in water of at least 1100 g/L at 20° C.

The molar ratio of acid to active agent (such as nicotine) may be selected as desired. In one aspect the molar ratio of acid to active agent (such as nicotine) is from 5:1 to 1:5. In one aspect the molar ratio of acid to active agent (such as nicotine) is from 4:1 to 1:4. In one aspect the molar ratio of acid to active agent (such as nicotine) is from 3:1 to 1:3. In one aspect the molar ratio of acid to active agent (such as nicotine) is from 2:1 to 1:2. In one aspect the molar ratio of acid to active agent (such as nicotine) is from 1.5:1 to 1:1.5. In one aspect the molar ratio of acid to active agent (such as nicotine) is from 1.2:1 to 1:1.2. In one aspect the molar ratio of acid to active agent (such as nicotine) is from 5:1 to 1:1. In one aspect the molar ratio of acid to active agent (such as nicotine) is from 4:1 to 1:1. In one aspect the molar ratio of acid to active agent (such as nicotine) is from 3:1 to 1:1. In one aspect the molar ratio of acid to active agent (such as nicotine) is from 2:1 to 1:1. In one aspect the molar ratio of acid to active agent (such as nicotine) is from 1.5:1 to 1:1. In one aspect the molar ratio of acid to active agent (such as nicotine) is from 1.2:1 to 1:1.

In one aspect the total content of acid present in the formulation is no greater than 5 mole equivalents based on the active agent (such as nicotine). In one aspect the total content of acid present in the formulation is no greater than 4 mole equivalents based on the active agent (such as nicotine). In one aspect the total content of acid present in the formulation is no greater than 3 mole equivalents based on the active agent (such as nicotine). In one aspect the total content of acid present in the formulation is no greater than 2 mole equivalents based on the active agent (such as nicotine). In one aspect the total content of acid present in the formulation is no greater than 1 mole equivalents based on the active agent (such as nicotine).

In one aspect the total content of acid present in the formulation is no less than 0.01 mole equivalents based on the active agent (such as nicotine). In one aspect the total content of acid present in the formulation is no less than 0.05 mole equivalents based on the active agent (such as nicotine). In one aspect the total content of acid present in the formulation is no less than 0.1 mole equivalents based on the active agent (such as nicotine). In one aspect the total content of acid present in the formulation is no less than 0.2 mole equivalents based on the active agent (such as nicotine). In one aspect the total content of acid present in the formulation is no less than 0.3 mole equivalents based on the active agent (such as nicotine). In one aspect the total content of acid present in the formulation is no less than 0.4 mole equivalents based on the active agent (such as nicotine). In one aspect the total content of acid present in the formulation is no less than 0.5 mole equivalents based on the active agent (such as nicotine). In one aspect the total content of acid present in the formulation is no less than 0.7 mole equivalents based on the active agent (such as nicotine).

In one aspect the acid is present in an amount of no greater than 6 wt % based on the aerosolizable formulation or based on the aerosolized formulation. In one aspect the acid is present in an amount of from 0.01 to 6 wt % based on the aerosolizable formulation or based on the aerosolized formulation. In one aspect the acid is present in an amount of from 0.02 to 6 wt % based on the aerosolizable formulation or based on the aerosolized formulation. In one aspect the acid is present in an amount of from 0.05 to 6 wt % based on the aerosolizable formulation or based on the aerosolized formulation. In one aspect the acid is present in an amount of from 0.08 to 6 wt % based on the aerosolizable formulation or based on the aerosolized formulation. In one aspect the acid is present in an amount of from 0.01 to 5 wt % based on the aerosolizable formulation or based on the aerosolized formulation. In one aspect the acid is present in an amount of from 0.02 to 5 wt % based on the aerosolizable formulation or based on the aerosolized formulation. In one aspect the acid is present in an amount of from 0.05 to 5 wt % based on the aerosolizable formulation or based on the aerosolized formulation. In one aspect the acid is present in an amount of from 0.08 to 5 wt % based on the aerosolizable formulation or based on the aerosolized formulation. In one aspect the acid is present in an amount of no greater than 4 wt % based on the aerosolizable formulation or based on the aerosolized formulation. In one aspect the acid is present in an amount of from 0.01 to 4 wt % based on the aerosolizable formulation or based on the aerosolized formulation. In one aspect the acid is present in an amount of from 0.02 to 4 wt % based on the aerosolizable formulation or based on the aerosolized formulation. In one aspect the acid is present in an amount of from 0.05 to 4 wt % based on the aerosolizable formulation or based on the aerosolized formulation. In one aspect the acid is present in an amount of from 0.08 to 4 wt % based on the aerosolizable formulation or based on the aerosolized formulation. In one aspect the acid is present in an amount of no greater than 3 wt % based on the aerosolizable formulation or based on the aerosolized formulation. In one aspect the acid is present in an amount of from 0.01 to 3 wt % based on the aerosolizable formulation or based on the aerosolized formulation. In one aspect the acid is present in an amount of from 0.02 to 3 wt % based on the aerosolizable formulation or based on the aerosolized formulation. In one aspect the acid is present in an amount of from 0.05 to 3 wt % based on the aerosolizable formulation or based on the aerosolized formulation. In one aspect the acid is present in an amount of from 0.08 to 3 wt % based on the aerosolizable formulation or based on the aerosolized formulation. In one aspect the acid is present in an amount of no greater than 2 wt % based on the aerosolizable formulation or based on the aerosolized formulation. In one aspect the acid is present in an amount of from 0.01 to 2 wt % based on the aerosolizable formulation or based on the aerosolized formulation. In one aspect the acid is present in an amount of from 0.02 to 2 wt % based on the aerosolizable formulation or based on the aerosolized formulation. In one aspect the acid is present in an amount of from 0.05 to 2 wt % based on the aerosolizable formulation or based on the aerosolized formulation. In one aspect the acid is present in an amount of from 0.08 to 2 wt % based on the aerosolizable formulation or based on the aerosolized formulation. In one aspect the acid is present in an amount of no greater than 1 wt % based on the aerosolizable formulation or based on the aerosolized formulation. In one aspect the acid is present in an amount of from 0.01 to 1 wt % based on the aerosolizable formulation or based on the aerosolized formulation. In one aspect the acid is present in an amount of from 0.02 to 1 wt % based on the aerosolizable formulation or based on the aerosolized formulation. In one aspect the acid is present in an amount of from 0.05 to 1 wt % based on the aerosolizable formulation or based on the aerosolized formulation. In one aspect the acid is present in an amount of from 0.08 to 1 wt % based on the aerosolizable formulation or based on the aerosolized formulation. In one aspect the acid is present in an amount of from 0.1 to 1 wt % based on the aerosolizable formulation or based on the aerosolized formulation. In one aspect the acid is present in an amount of no greater than 0.6 wt % based on the aerosolizable formulation or based on the aerosolized formulation. In one aspect the acid is present in an amount of from 0.01 to 0.6 wt % based on the aerosolizable formulation or based on the aerosolized formulation. In one aspect the acid is present in an amount of from 0.02 to 0.6 wt % based on the aerosolizable formulation or based on the aerosolized formulation. In one aspect the acid is present in an amount of from 0.05 to 0.6 wt % based on the aerosolizable formulation or based on the aerosolized formulation. In one aspect the acid is present in an amount of from 0.08 to 0.6 wt % based on the aerosolizable formulation or based on the aerosolized formulation. In one aspect the acid is present in an amount of from 0.1 to 0.6 wt % based on the aerosolizable formulation or based on the aerosolized formulation. In one aspect the acid is present in an amount of no greater than 0.5 wt % based on the aerosolizable formulation or based on the aerosolized formulation. In one aspect the acid is present in an amount of from 0.01 to 0.5 wt % based on the aerosolizable formulation or based on the aerosolized formulation. In one aspect the acid is present in an amount of from 0.02 to 0.5 wt % based on the aerosolizable formulation or based on the aerosolized formulation. In one aspect the acid is present in an amount of from 0.05 to 0.5 wt % based on the aerosolizable formulation or based on the aerosolized formulation. In one aspect the acid is present in an amount of from 0.08 to 0.5 wt % based on the aerosolizable formulation or based on the aerosolized formulation. In one aspect the acid is present in an amount of no greater than 0.2 wt % based on the aerosolizable formulation or based on the aerosolized formulation. In one aspect the acid is present in an amount of from 0.01 to 0.2 wt % based on the aerosolizable formulation or based on the aerosolized formulation. In one aspect the acid is present in an amount of from 0.02 to 0.2 wt % based on the aerosolizable formulation or based on the aerosolized formulation. In one aspect the acid is present in an amount of from 0.05 to 0.2 wt % based on the aerosolizable formulation or based on the aerosolized formulation. In one aspect the acid is present in an amount of from 0.08 to 0.2 wt % based on the aerosolizable formulation or based on the aerosolized formulation. In one aspect the acid is present in an amount of no greater than 0.1 wt % based on the aerosolizable formulation or based on the aerosolized formulation. In one aspect the acid is present in an amount of from 0.01 to 0.1 wt % based on the aerosolizable formulation or based on the aerosolized formulation. In one aspect the acid is present in an amount of from 0.02 to 0.1 wt % based on the aerosolizable formulation or based on the aerosolized formulation. In one aspect the acid is present in an amount of from 0.05 to 0.1 wt % based on the aerosolizable formulation or based on the aerosolized formulation. In one aspect the acid is present in an amount of from 0.08 to 0.1 wt % based on the aerosolizable formulation or based on the aerosolized formulation.

The amount of acid and the solubility of the acid may be selected such that a given amount of the acid will dissolve in the water. In one aspect at 20° C. at least 20% of the acid dissolves in the water. In one aspect at 25° C. at least 20% of the acid dissolves in the water. In one aspect at 30° C. at least 20% of the acid dissolves in the water. In one aspect at 20° C. at least 35% of the acid dissolves in the water. In one aspect at 20° C. at least 40% of the acid dissolves in the water. In one aspect at 20° C. at least 45% of the acid dissolves in the water. In one aspect at 20° C. at least 50% of the acid dissolves in the water. In one aspect at 20° C. at least 55% of the acid dissolves in the water.

As is understood by one skilled in the art, nicotine may exist in unprotonated form, monoprotonated form or diprotonated form. The structures of each of these forms are given below.

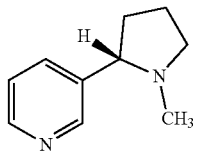

Unprotonated nicotine

-continued

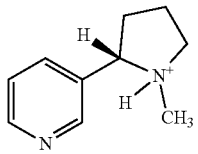

monoprotonated nicotine

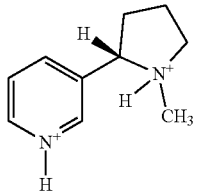

diprotonated nicotine

Reference in the specification to protonated form means both monoprotonated nicotine and diprotonated nicotine. Reference in the specification to amounts in the protonated form means the combined amount of monoprotonated nicotine and diprotonated nicotine. Furthermore, when reference is made to a fully protonated formulation it will be understood that at any one time there may be very minor amounts of unprotonated nicotine present, e.g. less than 1% unprotonated.

The formulation may comprise nicotine in protonated form. The formulation may comprise nicotine in unprotonated form. In one aspect the formulation comprises nicotine in unprotonated form and nicotine in monoprotonated form. In one aspect the formulation comprises nicotine in unprotonated form and nicotine in diprotonated form. In one aspect the formulation comprises nicotine in unprotonated form, nicotine in monoprotonated form and nicotine in diprotonated form.

In one aspect at least 5 wt % of the nicotine present in the formulation is in protonated form. In one aspect at least 10 wt % of the nicotine present in the formulation is in protonated form. In one aspect at least 15 wt % of the nicotine present in the formulation is in protonated form. In one aspect at least 20 wt % of the nicotine present in the formulation is in protonated form. In one aspect at least 25 wt % of the nicotine present in the formulation is in protonated form. In one aspect at least 30 wt % of the nicotine present in the formulation is in protonated form. In one aspect at least 35 wt % of the nicotine present in the formulation is in protonated form. In one aspect at least 40 wt % of the nicotine present in the formulation is in protonated form. In one aspect at least 45 wt % of the nicotine present in the formulation is in protonated form. In one aspect at least 50 wt % of the nicotine present in the formulation is in protonated form. In one aspect at least 55 wt % of the nicotine present in the formulation is in protonated form. In one aspect at least 60 wt % of the nicotine present in the formulation is in protonated form. In one aspect at least 65 wt % of the nicotine present in the formulation is in protonated form. In one aspect at least 70 wt % of the nicotine present in the formulation is in protonated form. In one aspect at least 75 wt % of the nicotine present in the formulation is in protonated form. In one aspect at least 80 wt % of the nicotine present in the formulation is in protonated form. In one aspect at least 85 wt % of the nicotine present in the formulation is in protonated form. In one aspect at least 90 wt % of the nicotine present in the formulation is in protonated form. In one aspect at least 95 wt % of the nicotine present in the formulation is in protonated form. In one aspect at least 99 wt % of the nicotine present in the formulation is in protonated form. In one aspect at least 99.9 wt % of the nicotine present in the formulation is in protonated form.

In one aspect from 50 to 95 wt % of the nicotine present in the formulation is in protonated form. In one aspect from 55 to 95 wt % of the nicotine present in the formulation is in protonated form. In one aspect from 60 to 95 wt % of the nicotine present in the formulation is in protonated form. In one aspect from 65 to 95 wt % of the nicotine present in the formulation is in protonated form. In one aspect from 70 to 95 wt % of the nicotine present in the formulation is in protonated form. In one aspect from 75 to 95 wt % of the nicotine present in the formulation is in protonated form. In one aspect from 80 to 95 wt % of the nicotine present in the formulation is in protonated form. In one aspect from 85 to 95 wt % of the nicotine present in the formulation is in protonated form. In one aspect from 90 to 95 wt % of the nicotine present in the formulation is in protonated form.

The relevant amounts of nicotine which are present in the formulation in protonated form are specified herein. These amounts may be readily calculated by one skilled in the art. Nicotine, 3-(1-methylpyrrolidin-2-yl)pyridine, is a diprotic base with pKa of 3.12 for the pyridine ring and 8.02 for the pyrrolidine ring It can exist in pH-dependent protonated (mono- and di-) and non-protonated (free base) forms which have different bioavailability.

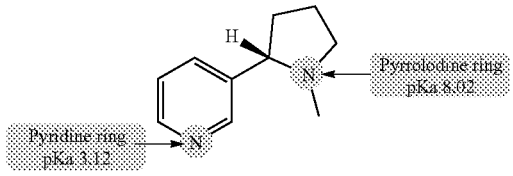

The distribution of protonated and non-protonated nicotine will vary at various pH increments.

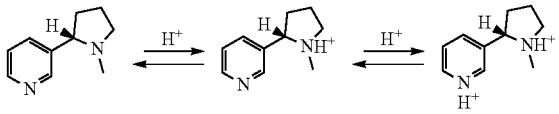

The fraction of non-protonated nicotine will be predominant at high pH levels whilst a decrease in the pH will see an increase of the fraction of protonated nicotine (mono- or di-depending on the pH). If the relative fraction of protonated nicotine and the total amount of nicotine in the sample are known, the absolute amount of protonated nicotine can be calculated.

The relative fraction of protonated nicotine in formulation can be calculated by using the Henderson-Hasselbalch equation, which describes the pH as a derivation of the acid dissociation constant equation, and it is extensively employed in chemical and biological systems. Consider the following equilibrium:

$$B+H^+ \leftrightharpoons BH^+$$

The Henderson-Hasselbalch Equation for this Equilibrium is:

$$\mathrm{pH} = pKa + \log\frac{[B]}{[BH+]}$$

Where [B] is the amount of non-protonated nicotine (i.e. free base), [$BH^+$] the amount of protonated nicotine (i.e. conjugate acid) and pKa is the reference pKa value for the pyrrolidine ring nitrogen of nicotine (pKa=8.02). The relative fraction of protonated nicotine can be derived from the alpha value of the non-protonated nicotine calculated from the Henderson-Hasselbalch equation as:

$$\%\ \text{protonated nicotine} = 100 - \left\{\frac{\frac{[B]}{[BH+]}}{\left\{1+\frac{[B]}{[BH+]}\right\}} * 100\right\}$$

Determination of pKa values of nicotine formulations was carried out using the basic approach described in "Spectroscopic investigations into the acid-base properties of nicotine at different temperatures", Peter M. Clayton, Carl A. Vas, Tam T. T. Bui, Alex F. Drake and Kevin McAdam, Anal. Methods, 2013, 5, 81-88.

Formulation

One or more cyclodextrins may or may not be present in any suitable amount in the aerosolizable formulation. In one aspect the one or more cyclodextrins are present in a total amount of no greater than 12 wt. % based on the aerosolizable formulation. In one aspect the one or more cyclodextrins are present in a total amount of no greater than 10 wt. % based on the aerosolizable formulation. In one aspect the one or more cyclodextrins are present in a total amount of no greater than 9 wt. % based on the aerosolizable formulation. In one aspect the one or more cyclodextrins are present in a total amount of no greater than 8 wt. % based on the aerosolizable formulation. In one aspect the one or more cyclodextrins are present in a total amount of no greater than 7 wt. % based on the aerosolizable formulation. In one aspect the one or more cyclodextrins are present in a total amount of no greater than 6 wt. % based on the aerosolizable formulation. In one aspect the one or more cyclodextrins are present in a total amount of no greater than 5 wt. % based on the aerosolizable formulation. In one aspect the one or more cyclodextrins are present in a total amount of no greater than 4 wt. % based on the aerosolizable formulation. In one aspect the one or more cyclodextrins are present in a total amount of no greater than 3 wt. % based on the aerosolizable formulation. In one aspect the one or more cyclodextrins are present in a total amount of no greater than 2 wt. % based on the aerosolizable formulation. In one aspect the one or more cyclodextrins are present in a total amount of no greater than 1 wt. % based on the aerosolizable formulation. In one aspect the one or more cyclodextrins are present in a total amount of no greater than 0.5 wt. % based on the aerosolizable formulation. In one aspect the one or more cyclodextrins are present in a total amount of no greater than 0.1 wt. % based on the aerosolizable formulation. In one aspect the one or more cyclodextrins are present in a total amount of no greater than 0.01 wt. % based on the aerosolizable formulation. In one aspect the one or more cyclodextrins are present in a total amount of no greater than 0.001 wt. % based on the aerosolizable formulation.

One or more cyclodextrins may or may not be present in any suitable amount in the aerosolized formulation. In one aspect the one or more cyclodextrins are present in a total amount of no greater than 12 wt. % based on the aerosolized formulation. In one aspect the one or more cyclodextrins are present in a total amount of no greater than 10 wt. % based on the aerosolized formulation. In one aspect the one or more cyclodextrins are present in a total amount of no greater than 9 wt. % based on the aerosolized formulation. In one aspect the one or more cyclodextrins are present in a total amount of no greater than 8 wt. % based on the aerosolized formulation. In one aspect the one or more cyclodextrins are present in a total amount of no greater than 7 wt. % based on the aerosolized formulation. In one aspect the one or more cyclodextrins are present in a total amount of no greater than 6 wt. % based on the aerosolized formulation. In one aspect the one or more cyclodextrins are present in a total amount of no greater than 5 wt. % based on the aerosolized formulation. In one aspect the one or more cyclodextrins are present in a total amount of no greater than 4 wt. % based on the aerosolized formulation. In one aspect the one or more cyclodextrins are present in a total amount of no greater than 3 wt. % based on the aerosolized formulation. In one aspect the one or more cyclodextrins are present in a total amount of no greater than 2 wt. % based on the aerosolized formulation. In one aspect the one or more cyclodextrins are present in a total amount of no greater than 1 wt. % based on the aerosolized formulation. In one aspect the one or more cyclodextrins are present in a total amount of no greater than 0.5 wt. % based on the aerosolized formulation. In one aspect the one or more cyclodextrins are present in a total amount of no greater than 0.1 wt. % based on the aerosolized formulation. In one aspect the one or more cyclodextrins are present in a total amount of no greater than 0.01 wt. % based on the aerosolized formulation. In one aspect the one or more cyclodextrins are present in a total amount of no greater than 0.001 wt. % based on the aerosolized formulation.

The one or more cyclodextrins may be selected from the group consisting of unsubstituted cyclodextrins, substituted cyclodextrins and mixtures thereof. In one aspect at least one cyclodextrin is an unsubstituted cyclodextrin. In one aspect the one or more cyclodextrins are selected from the group consisting of unsubstituted cyclodextrins. In one aspect at least one cyclodextrin is a substituted cyclodextrin. In one aspect the one or more cyclodextrins are selected from the group consisting of substituted cyclodextrins.

In one aspect the one or more cyclodextrins are selected from the group consisting of unsubstituted (α)-cyclodextrin, substituted (α)-cyclodextrin, unsubstituted (β)-cyclodextrin, substituted (β)-cyclodextrin, unsubstituted (γ)-cyclodextrin, substituted (γ)-cyclodextrin, and mixtures thereof. In one aspect the one or more cyclodextrins are selected from the group consisting of unsubstituted (β)-cyclodextrin, substituted (β)-cyclodextrin, and mixtures thereof.

In one aspect the one or more cyclodextrins are selected from the group consisting of unsubstituted (α)-cyclodextrin, unsubstituted (β)-cyclodextrin, unsubstituted (γ)-cyclodextrin, and mixtures thereof. In one aspect the one or more cyclodextrins is selected from unsubstituted (β)-cyclodextrin.

In one aspect the one or more cyclodextrins are selected from the group consisting of substituted (α)-cyclodextrin, substituted (β)-cyclodextrin, substituted (γ)-cyclodextrin, and mixtures thereof. In one aspect the one or more cyclodextrins is selected from substituted (β)-cyclodextrins.

Chemical substitutions at the 2-, 3-, and 6-hydroxyl sites are envisaged, and in particular substitution at the 2-position.

In one aspect the one or more cyclodextrins are selected from the group consisting of 2-hydroxy-propyl-α-cyclodextrin, 2-hydroxy-propyl-β-cyclodextrin, 2-hydroxy-propyl-γ-cyclodextrin and mixtures thereof. In one aspect the one or more cyclodextrins is at least 2-hydroxy-propyl-α-cyclodextrin. In one aspect the one or more cyclodextrins is at least 2-hydroxy-propyl-β-cyclodextrin. In one aspect the one or more cyclodextrins is at least 2-hydroxy-propyl-γ-cyclodextrin.

2-hydroxy-propyl derivatives of cyclodextrins, such as 2-hydroxy-propyl-β-cyclodextrin have increased solubility in water when compared to base cyclodextrins such as β-cyclodextrin.

In one aspect if the aerosolizable formulation contains one or more cyclodextrins, then the aerosolizable formulation contains no flavors that can be encapsulated by the one or more cyclodextrins.

Process

As discussed herein, in one aspect there is provided a process for forming an aerosol, the process comprising aerosolizing an aerosolizable formulation comprising (i) water in an amount of at least 50 wt. % based on the aerosolized formulation; and (ii) at least one flavor;

to provide an aerosol containing the at least one flavor in an amount of at least 70 wt % of the said flavor present in the aerosolizable formulation.

In the process the aerosol may be formed by a process performed at a temperature below 60° C. In the process the aerosol may be formed by a process performed at a temperature below 50° C. In the process the aerosol may be formed by a process performed at a temperature below 40° C. In the process the aerosol may be formed by a process performed at a temperature below 30° C. In the process the aerosol may be formed by a process performed at a temperature below 25° C. In the process the aerosol may be formed by a process which does not involve heating.

In the process the aerosol may be formed by applying ultrasonic energy to the aerosolizable formulation.

In one aspect the aerosol the aerosol of the aerosolized formulation has a D50 of from 2 to 6 μm. References in the present specification to particle size distribution, D50, D10 or D90 refer to values measured in accordance with British and European Pharmacopoeia, 2.9.31 Particle Size Analysis By Laser Light Diffraction (see BRITISH PHARMACOPOEIA COMMISSION. (2014), British Pharmacopoeia. London, England: Stationery Office and COUNCIL OF EUROPE. (2013). European Pharmacopoeia. Strasbourg, France: Council of Europe). The terms D50, Dv50 and Dx50 are interchangeable. The terms D10, Dv10 and Dx10 are interchangeable. The terms D90, Dv90 and Dx90 are interchangeable.

In one aspect the aerosol has a D50 of from 2.5 to 6 μm. In one aspect the aerosol has a D50 of from 3 to 6 μm. In one aspect the aerosol has a D50 of from 3.5 to 6 μm. In one aspect the aerosol has a D50 of from 4 to 6 μm. In one aspect the aerosol has a D50 of from 4.5 to 6 μm.

In one aspect the aerosol has a D50 of from 5 to 6 μm. In one aspect the aerosol has a D50 of from 2.5 to 5.5 μm. In one aspect the aerosol has a D50 of from 3 to 5.5 μm. In one aspect the aerosol has a D50 of from 3.5 to 5.5 μm. In one aspect the aerosol has a D50 of from 4 to 5.5 μm. In one aspect the aerosol has a D50 of from 4.5 to 5.5 μm. In one aspect the aerosol has a D50 of from 5 to 5.5 μm.

In one aspect the aerosol has a D10 of at least 0.5 μm. In one aspect the aerosol has a D10 of at least 1 μm. In one aspect the aerosol has a D10 of at least 2 μm.

In one aspect the aerosol has a D90 of no greater than 15 μm. In one aspect the aerosol has a D90 of no greater than 12 μm. In one aspect the aerosol has a D90 of no greater than 10 μm.

In one aspect D50 is measured after exclusion of particles having a particle size of less than 1 μm. In one aspect D10 is measured after exclusion of particles having a particle size of less than 1 μm. In one aspect D90 is measured after exclusion of particles having a particle size of less than 1 μm.

The formulation may be contained or delivered by any means. In one aspect the present invention provides a contained aerosolizable formulation comprising (a) one or more containers; and (b) an aerosolizable formulation as defined herein. The container may be any suitable container, for example to allow for the storage or delivery of the formulation. In one aspect the container is configured for engagement with an electronic aerosol provision system. The container may be configured to become fluidly in communication with an electronic aerosol provision system so that formulation may be delivered to the electronic aerosol provision system. As described above, the present disclosure relates to container which may be used in an electronic aerosol provision system, such as an e-cigarette. Throughout the following description the term "e-cigarette" is used; however, this term may be used interchangeably with electronic aerosol provision system.

As discussed herein, the container of the present invention is typically provided for the delivery of aerosolizable formulation to or within an e-cigarette. The aerosolizable formulation may be held within an e-cigarette or may be sold as a separate container for subsequent use with or in an e-cigarette. As understood by one skilled in the art, e-cigarettes may contain a unit known as a detachable cartomizer which typically comprises a reservoir of aerosolizable formulation, and an aerosolizer such as a wick material and a heating element for vaporizing the aerosolizable formulation. In some e-cigarettes, the cartomizer is part of a single-piece device and is not detachable. In one aspect the container is a cartomizer or is part of a cartomizer. In one aspect the container is not a cartomizer or part of a cartomizer and is a container, such as a tank, which may be used to deliver nicotine formulation to or within an e-cigarette.

In one aspect the container is part of an e-cigarette. Therefore in a further aspect the present invention provides an electronic aerosol provision system comprising: an aerosolizable formulation as defined herein; an aerosolizer for aerosolizing formulation for inhalation by a user of the electronic aerosol provision system; and a power supply comprising a cell or battery for supplying power to the aerosolizer.

In addition to the aerosolizable formulation of the present invention and to systems such as containers and electronic aerosol provision systems containing the same, the present invention provides a process for improving the sensory properties of an aerosolized nicotine. In a further aspect the present invention provides a process for improving the storage stability of an aerosolized nicotine formulation.

Reference to an improvement in the sensory properties of a vaporized nicotine solution refer may include an improvement in the smoothness of the vaporized nicotine solution as perceived by a user.

The process of the present invention may comprises additional steps either before the steps listed, after the steps listed or between one or more of the steps listed.

The invention will now be described with reference to the following non-limiting example.

EXAMPLES

Example 1

A series of tests were conducted using a formulation containing 90.0% (w/w) water, 9.0% 2-hydroxy-propyl-β-cyclodextrin, 0.9% 1-menthol, and 0.1% nicotine.

In this embodiment, measurements of menthol and nicotine are made via Gas Chromatography and a suitable detection mechanism, such as Flame Ionisation Detection (CG-FID).

Upon aerosolization the complexation mechanism between 1-menthol and 2-hydroxy-propyl-β-cyclodextrin becomes dynamic due to the transfer of kinetic energy from the device to the formulation. Thus, the menthol can migrate back into the host 2-hydroxy-propyl-β-cyclodextrin as a guest molecule if the aerosol transit time is long enough.

An experiment was designed to capture the condensed formulation on a cooler than ambient surface to provide equivalent menthol and nicotine measurements post-aerosolization. Since 1-menthol is expected to be released from the host 2-hydroxy-propyl-β-cyclodextrin upon energy transfer, any differences between pre- and post-aerosolization can be attributed to its release as a vapor, due to hydrophobic behavior of 1-menthol.

It should be noted that the behavior of nicotine in this example is omitted, since it is soluble in water and it is expected to be trapped within the water droplets in the particulate phase.

In practice, since the complexation mechanism is dynamic, we expect negligible differences between the formulation pre- and post-aerosolization. This is the observed effect using GC-FID as the measurement system. A tolerance of ±10% is suitable in this case.

Example 2

A series of formulations we prepared according to the described methodology and tested for flavor compounds by the analytical laboratory.

The device was loaded with formulations containing 83.1% (w/w) water, 15.0% (w/w) 2-hydroxy-propyl-β-cyclodextrin, 0.9% (w/w) 1-menthol and 1% (w/w) nicotine; and 98.8% (w/w) water, 0.6% (w/w) vanillin and 0.6% (w/w) nicotine.

In both examples the formulation was aerosolized using commercially available nebulizer and generated aerosol collected onto 44 mm Cambridge Filter Pads (CFP) followed by 2 impingers connected in series containing isopropyl alcohol and internal standards for quantitation. This was done to make sure that both gas and droplet phases are captured for analysis. The aerosol generation and sample analysis for both formulations were performed in triplicates. The analytical testing was conducted using gas-chromatography (Agilent 7890A Gas chromatograph or equivalent), couple with mass spectroscopy (Markes Bench Time of Flight or equivalent). For each replicate 20 puffs were collected using a single port smoking machine such as Borgwaldt LX or equivalent. The weight of CFP was recorded before and after aerosol capture. Then CFP was extracted using the combined solutions from both impingers and analyzed for targeted compounds. Prior to analysis 5 point calibration curve was built with high purity standards for quantification purposes. The formulations were analyzed prior to aerosolization to demonstrate the amounts of flavor before and after the process.

The liquid analysis of formulation containing 1-menthol showed 0.8% (w/w) (8 mg/g) 1-menthol and 1.0% (w/w) (10 mg/g) nicotine. The aerosol analysis of the same formulation showed 0.7-0.8% (w/w) (7 to 8 mg/g) 1-menthol and 1-1.1% (w/w) (10 to 11 mg/g) nicotine.

The liquid analysis of formulation containing vanillin showed 0.5% (w/w) (5 mg/g) vanillin and 0.6% (w/w) (6 mg/g) nicotine. The aerosol analysis of the same formulation showed 0.5-0.6% (w/w) (5 to 6 mg/g) vanillin and 0.6% (w/w) (6 mg/g) nicotine.

The results showed 100% flavor and nicotine recovery and indicated no degradation of active ingredients during aerosolization process.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. An aerosolized formulation comprising:

(i) water in an amount of at least 50 wt. % based on the aerosolized formulation; and (ii) at least one flavor; and (iii) one or more substituted cyclodextrins present in a total amount of from 0.001 wt. % to 8 wt. % based on the aerosolized formulation;

wherein the aerosolized formulation contains the at least one flavor in an amount of at least 70 wt. % of the at least one flavor present in an aerosolizable formulation from which the aerosolized formulation was formed, wherein an aerosol of the aerosolized formulation has the following particle size distribution: a D10 of at least 0.5 μm.

2. The aerosolized formulation according to claim 1, wherein water is present in an amount of at least 75 wt. % based on the aerosolized formulation.

3. The aerosolized formulation according to claim 1, wherein water is present in an amount of at least 90 wt. % based on the aerosolized formulation.

4. The aerosolized formulation according to claim 1, wherein the at least one flavor is selected from the group consisting of (4-(para-) methoxyphenyl)-2-butanone, vanillin, γ-undecalactone, menthone, 5-propenyl guaethol, menthol, para-mentha-8-thiol-3-one and mixtures thereof.

5. The aerosolized formulation according to claim 1, wherein the at least one flavors comprises menthol.

6. The aerosolized formulation according to claim 1, wherein the at least one flavor is present in a total amount of no greater than 2 wt. % based on the aerosolized formulation.

7. The aerosolized formulation according to claim 1, wherein the at least one flavor is present in a total amount of from 0.01 to 1 wt. % based on the aerosolized formulation.

8. The aerosolized formulation according to claim 1, wherein the aerosolized formulation contains the at least one flavor in an amount of at least 80 wt. % of the at least one flavor present in the aerosolizable formulation from which the aerosolized formulation was formed.

9. The aerosolized formulation according to claim 1, wherein the aerosolized formulation contains the at least one flavor in an amount of at least 90 wt. % of the at least one flavor present in the aerosolizable formulation from which the aerosolized formulation was formed.

10. The aerosolized formulation according to claim 1, wherein the aerosolized formulation contains more than one flavor.

11. The aerosolized formulation according to claim 10, wherein the aerosolized formulation contains each of the more than one flavors in an amount of at least 70 wt. % of each of the more than one flavor present in the aerosolizable formulation from which the aerosolized formulation was formed.

12. The aerosolized formulation according to claim 1, further comprising one or more cyclodextrins present in a total amount of from 0.001 wt. % to 0.5 wt. % based on the aerosolized formulation.

13. The aerosolized formulation according to claim 1, wherein the aerosolized formulation further comprises at least one active agent.

14. The aerosolized formulation according to claim 13, wherein the active agent is present in an amount of no greater than 1 wt. % based on the aerosolized formulation.

15. The aerosolized formulation according to claim 13, wherein the active agent is present in an amount of from 0.01 to 0.6 wt. % based on the aerosolized formulation.

16. The aerosolized formulation according to claim 13, wherein the active agent comprises nicotine.

17. The aerosolized formulation according to claim 1, wherein the aerosolized formulation further comprises an acid.

18. The aerosolized formulation according to claim 17, wherein the acid is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof.

19. The aerosolized formulation according to claim 17, wherein the acid is selected from the group consisting of citric acid, benzoic acid, levulinic acid, lactic acid, sorbic acid, and mixtures thereof.

20. The aerosolized formulation according to claim 17, wherein the acid comprises citric acid.

21. The aerosolized formulation according to claim 1, wherein the aerosolizable formulation contains no flavors that can be encapsulated by the one or more substituted cyclodextrins.

* * * * *